US009394087B2

(12) United States Patent
Phillips et al.

(10) Patent No.: US 9,394,087 B2
(45) Date of Patent: Jul. 19, 2016

(54) FLUID FLOW CONTROL DEVICE FOR A CONTAINER

(75) Inventors: Shandley K. Phillips, San Diego, CA (US); Allyson L. Phillips, San Diego, CA (US)

(73) Assignee: Lids2Go Holdings Inc., Coldstream (CA)

( * ) Notice: Subject to any disclaimer, the term of this patent is extended or adjusted under 35 U.S.C. 154(b) by 0 days.

(21) Appl. No.: 13/882,911

(22) PCT Filed: Feb. 10, 2012

(86) PCT No.: PCT/US2012/000081

§ 371 (c)(1),
(2), (4) Date: May 1, 2013

(87) PCT Pub. No.: WO2012/108962

PCT Pub. Date: Aug. 16, 2012

(65) Prior Publication Data

US 2013/0256309 A1 Oct. 3, 2013

Related U.S. Application Data

(60) Provisional application No. 61/441,417, filed on Feb. 10, 2011.

(51) Int. Cl.

| | |
|---|---|
| ***B65D 47/12*** | (2006.01) |
| ***B65D 39/02*** | (2006.01) |
| ***A47G 19/22*** | (2006.01) |

(52) U.S. Cl.

CPC ..... *B65D 47/12* (2013.01); *A47G 19/2211* (2013.01); *B65D 39/02* (2013.01)

(58) Field of Classification Search

CPC .... B65D 47/12; B65D 39/0076; B65D 39/02; A47G 19/2205; A47G 19/2211; A47G 19/2272

USPC ..... 220/262, 287, 703, 711, 713, 714, 719, 220/731, 796, 800; 215/387

See application file for complete search history.

(56) References Cited

U.S. PATENT DOCUMENTS

| | | | | |
|---|---|---|---|---|
| 1,254,251 | A | | 1/1918 | Magnus |
| 2,030,841 | A | | 2/1936 | Anaya |
| 2,529,114 | A | * | 11/1950 | Tellier ..... 220/713 |
| 4,130,215 | A | | 12/1978 | Corey et al. |

(Continued)

FOREIGN PATENT DOCUMENTS

| | | |
|---|---|---|
| GB | 415907 | 9/1934 |
| WO | WO 2008/067407 | 6/2008 |
| WO | WO 2009/126042 | 10/2009 |

OTHER PUBLICATIONS

United States U.S. Appl. No. 61/441,417, filed Feb. 10, 2011.

(Continued)

*Primary Examiner* — Fenn Mathew
*Assistant Examiner* — Madison L Poos
(74) *Attorney, Agent, or Firm* — Craig R. Miles; CR Miles P.C.

(57) ABSTRACT

A fluid flow control device having plurality of flexible fluid flow control elements disposed in spaced apart relation about the periphery of a solid body which insertably secured in a container provides a plurality of apertures in spaced apart relation about the periphery of the solid body which control the flow rate of an amount of fluid from the container.

19 Claims, 10 Drawing Sheets

(56) References Cited

U.S. PATENT DOCUMENTS

| | | | | |
|---|---|---|---|---|
| 4,412,629 | A | | 11/1983 | Dart et al. |
| 4,795,052 | A | | 1/1989 | Hayes |
| 4,842,157 | A | | 6/1989 | Stone-Parker et al. |
| 4,986,437 | A | | 1/1991 | Farmer |
| 5,168,140 | A | | 12/1992 | Welker |
| 5,217,141 | A | | 6/1993 | Ross |
| 5,553,731 | A | | 9/1996 | Schuyler |
| 5,573,139 | A | | 11/1996 | Yeh |
| 5,971,202 | A | * | 10/1999 | Filbrun ..... 220/719 |
| 6,199,711 | B1 | | 3/2001 | Lansky |
| 6,318,584 | B1 | | 11/2001 | Milan |
| 6,398,064 | B1 | | 6/2002 | Cornwall |
| 6,656,514 | B1 | | 12/2003 | Tubbs |
| 6,702,145 | B2 | | 3/2004 | Malcolm |
| 6,705,485 | B1 | | 3/2004 | Sato et al. |
| 6,752,287 | B1 | | 6/2004 | Lin |
| 7,017,768 | B2 | | 3/2006 | Iskierka |
| 7,147,126 | B2 | | 12/2006 | Samson et al. |
| 7,168,589 | B2 | | 1/2007 | Dark |
| 7,644,834 | B2 | | 1/2010 | Castora et al. |
| 7,959,029 | B2 | | 6/2011 | Whitaker et al. |
| 8,033,420 | B2 | | 10/2011 | Roseblade et al. |
| 8,056,755 | B2 | | 11/2011 | Williams |
| 8,444,004 | B1 | | 5/2013 | Draganic et al. |
| 8,453,870 | B2 | | 6/2013 | Berg et al. |
| 2005/0205587 | A1 | | 9/2005 | Sampson et al. |
| 2008/0156817 | A1 | | 7/2008 | Roseblade et al. |
| 2010/0294765 | A1 | | 11/2010 | Kemper et al. |
| 2011/0101008 | A1 | | 5/2011 | Draganic |
| 2012/0024873 | A1 | | 2/2012 | Roseblade et al. |

OTHER PUBLICATIONS

International PCT Patent Application No. PCT/US2012/000081, filed Feb. 10, 2012.

Reflo. Buy your cups online with us . . . or . . . at stores listed here! Website, https://reflo.net, originally downloaded Jan. 3, 2014, 1 page.

Reflo. Product information. Website, https://reflo.net, originally downloaded Jan. 3, 2014, 1 page.

Reflo. Product information. Website, https://web.archive.org, originally downloaded Jan. 3, 2014, 1 page.

Reflo. Reno. On-line catalog, https://web.archive.org, originally downloaded Jan. 3, 2014, 2 total pages.

Toysrus. Sassy Grow Up Cup No Spill, No Spout Design 2 pack 9oz—12+ Months (Neutral). Website, http://toysrus.com, originally downloaded Mar. 6, 2014, 5 total pages.

Corresponding EP Patent Application No. 12744901.5; OA dated Oct. 9, 2014, 6 total pages.

* cited by examiner

FLUID FLOW CONTROL DEVICE FOR A CONTAINER

This application is the United States National Stage of International Patent Cooperation Treaty Application No. PCT/US2012/000081, filed Feb. 10, 2012, which claims the benefit of U.S. Provisional Patent Application No. 61/441,417, filed Feb. 10, 2011, each hereby incorporated by reference herein.

I. TECHNICAL FIELD

Generally, a fluid flow control device having a plurality of flexible fluid flow control elements disposed in spaced apart relation about the periphery of a solid body which insertably secured in a container provides a plurality of apertures in spaced apart relation about the periphery of the solid body which control the flow rate of an amount of fluid from the container.

II. BACKGROUND

There a numerous and wide variety of conventional lids which couple to containers for the purpose of regulating flow of fluids from the containers. However, there remain long standing unresolved disadvantages associated with conventional lids for containers.

One disadvantage of conventional lids for container may be that for each configuration of container there is a specific configuration of lid. Even minor variation in the dimensions of the lid or the container can prohibit joining the lid to the container or prevent the lid from sealing with the container to prevent leaks.

Another disadvantage of conventional lids for containers can be that the lid has one or more apertures which allow the fluid to flow from the container regardless of the orientation of the container. For example, unless the apertures of a conventional lid are plugged, there is no control over the flow of fluid through the aperture. When the one or more apertures of a conventional lid are unplugged the fluid will flow upon sufficient tilting of the container, for example when drinking from the container; however, the fluid will flow through the aperture of the lid even when the container mistakenly inverted.

Another disadvantage of conventional lids which insert inside of containers can be that the lids are substantially planar and the lid edges to not sufficiently seal in contact with the interior wall of the container. Additionally, apertures formed by combination of the interior wall and the lid may not be adjustable in dimension relations by adjustment of the lid in relation to the interior wall of the container.

The present invention provides a fluid flow control device for a lid which couples to a container in manner which addresses the above-described long felt but unresolved disadvantages.

III. DISCLOSURE OF INVENTION

Accordingly, a broad object of the invention can be to provide a fluid flow control device having a plurality of flexible fluid flow control elements disposed in spaced apart relation about the periphery of a solid body which insertably secured in a container provides a plurality of apertures in spaced apart relation about the periphery of the solid body which control the flow rate of an amount of fluid from the container.

Another broad object of the invention can be to provide a method of controlling the flow of an amount of fluid from a container through a plurality of apertures formed by contacting the curved surface of each of a plurality of flexible fluid flow control elements disposed in spaced apart relation about the periphery of a solid body with the interior wall of a container.

Naturally, further objects of the invention are disclosed throughout other areas of the specification and drawings.

IV. BRIEF DESCRIPTION OF THE DRAWINGS

V. MODE(S) FOR CARRYING OUT THE INVENTION

Figure 1:
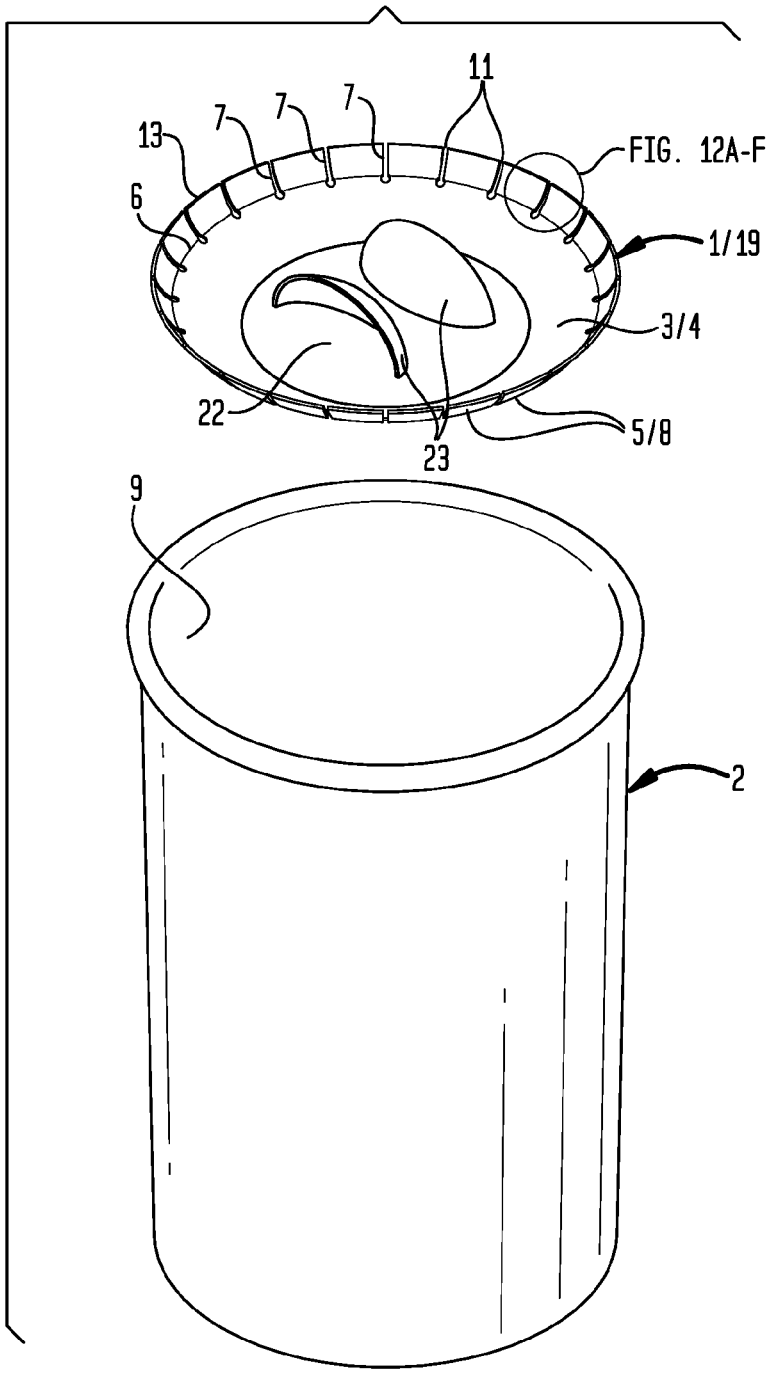
FIG. 1 is an illustration of providing a particular embodiment of a fluid flow control device configured to fit a container.
Figure 2:
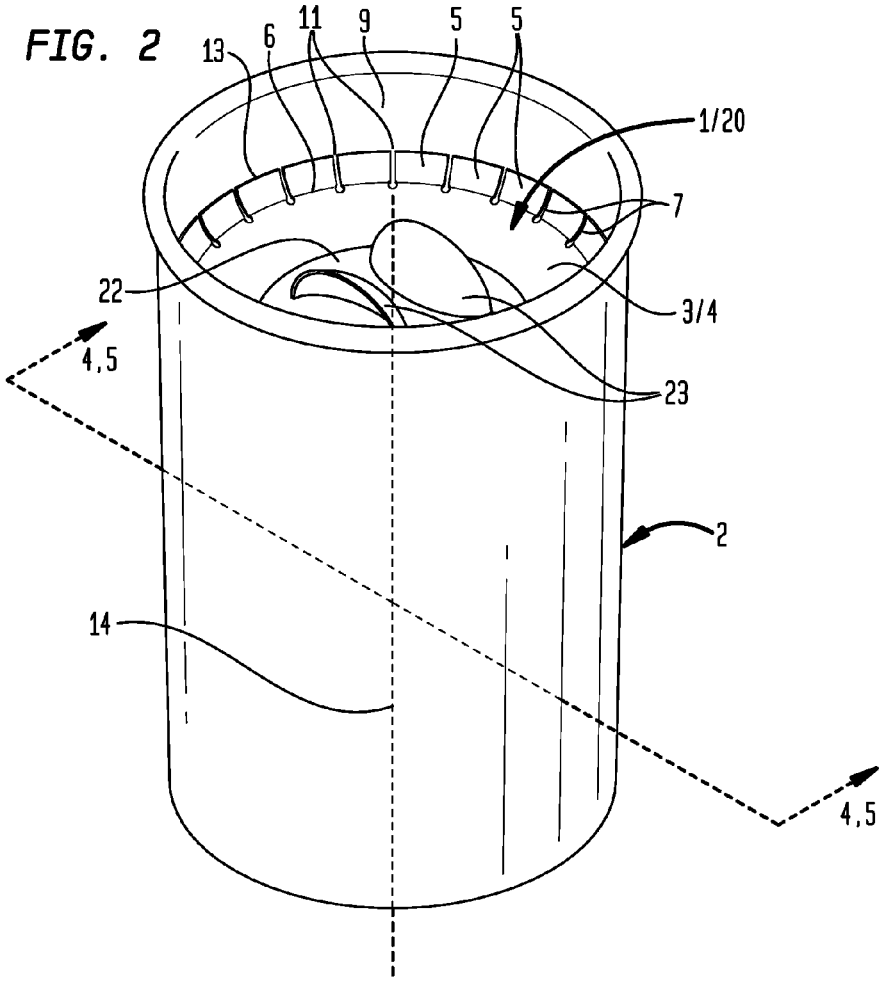
FIG. 2 is an illustration of positioning a particular embodiment of a fluid flow control device in a container.
Figure 3:
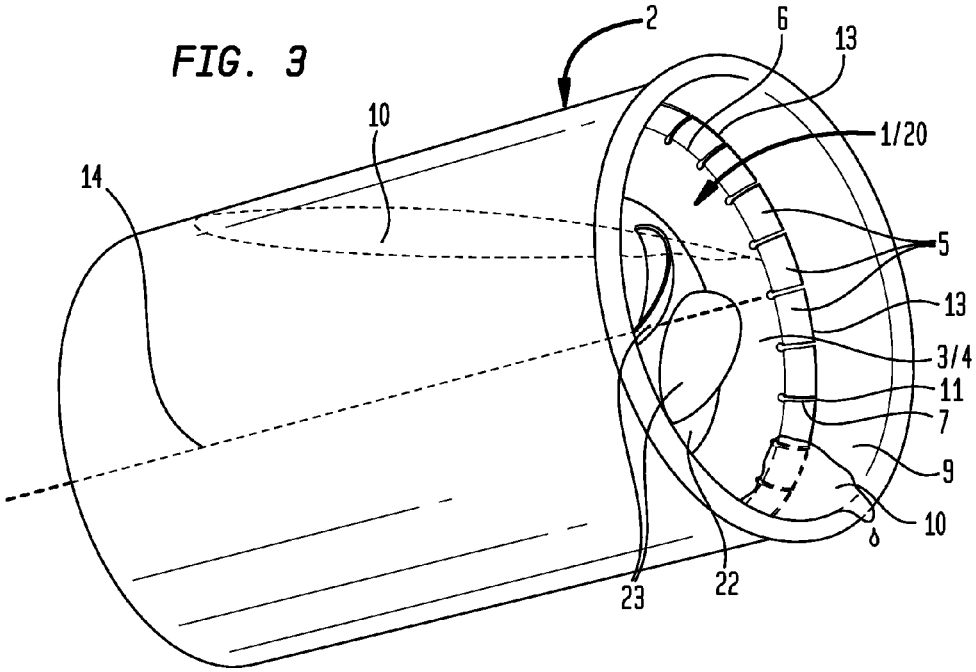
FIG. 3 is an illustration of flowing an amount of liquid through a plurality of radial slit elements of a particular embodiment of the fluid flow control device positioned in a container.
Figure 4:
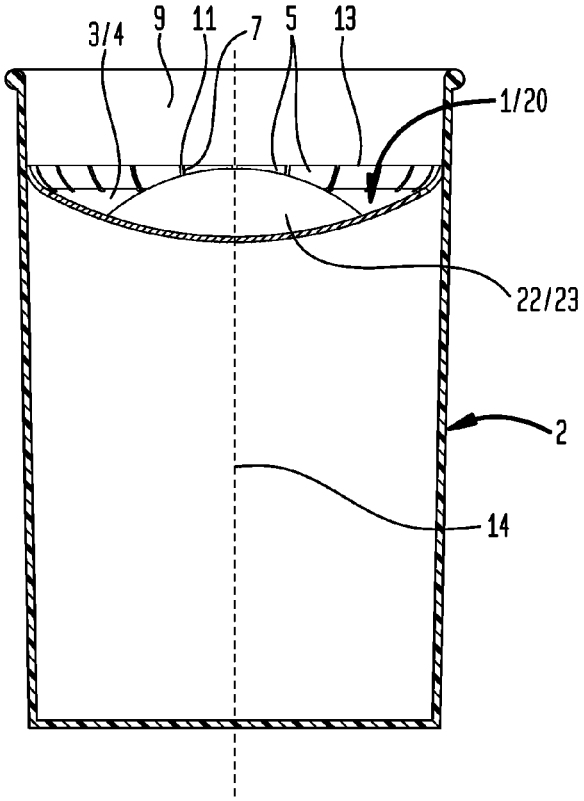
FIG. 4 is cross section 4-4 as shown in FIG. 2 which shows a particular embodiment of the fluid flow control device inserted in a container.

Now referring primarily to FIGS. 1 through 3, which illustrate a method of using a particular embodiment of a fluid flow control device (1). The fluid flow control device (1) can be utilized in combination with a container (2). The particular embodiment of the fluid flow control device (1) shown in the examples of FIGS. 1 through 3 includes a solid body (3) having a concave surface (4). A plurality of flexible fluid flow control elements (5) coupled in spaced apart relation about the peripheral edge (6) of the solid body (3) define a corresponding plurality of radial slit elements (7) between each adjacent pair of the plurality of flexible fluid flow control elements (5)(as shown in the example of FIG. 1), and as further described in detail below.

An amount of fluid (10)(shown in broken line in the example of FIG. 3) can be transferred to a container (2). A user can locate the fluid flow control device (1) inside the container (2) by contacting the outwardly disposed curved surface (8) of each of a plurality of flexible fluid flow control elements (5) with a corresponding portion of the interior wall (9) of the container (2). The fluid flow control device (1) can be positioned by upward or downward movement of the fluid flow control device (1) in the container (2). Resilient flexure of the plurality of flexible fluid flow control elements (5) in contact with the interior wall (9) of the container (2) can secure location of the fluid flow control device (1) in relation to the interior wall (9) of the container (2)(as shown in the example of FIG. 2).

Figure 5:
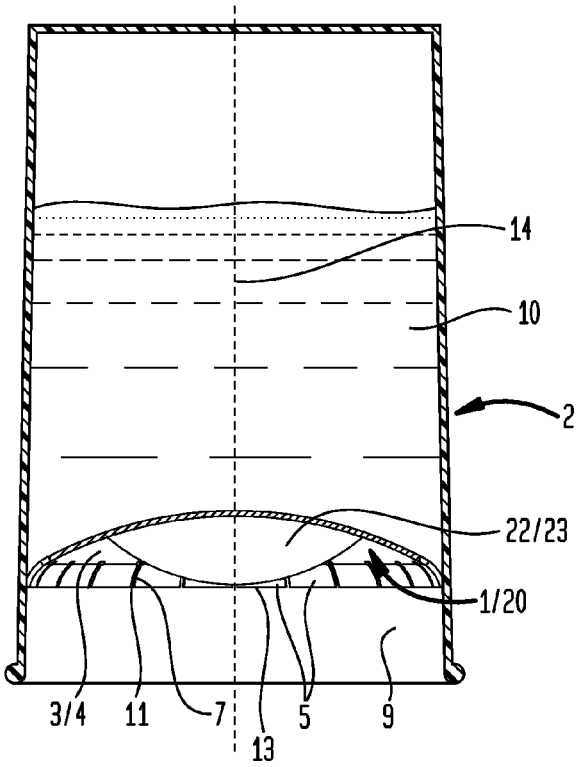
FIG. 5 is cross section 5-5 as shown in FIG. 2 which shows a particular embodiment of the fluid flow control device inserted in an inverted container containing an amount of fluid, the radial slit elements configured to substantially prevent flow of the liquid in the inverted orientation of the container.

The container (2) can be sufficiently tilted to allow flow of the fluid (10) through a plurality of radial slit openings (11) defined by a plurality of radial slit elements (7)(as shown by the example of FIG. 3). As to certain embodiments, the plurality of radial slit elements (7) can be configured to control the fluid flow rate through the corresponding plurality of radial slit openings (11) to allow flow of the fluid (10)(as shown in the example of FIG. 3) from the container (2). Additionally, the plurality of slit elements (7) can be configured to interrupt flow of the fluid (10) when the container (2) is inverted (as shown by the example of FIG. 5), as further described below. Removal of the fluid flow control device (1) from the container (2) can be accomplished by tilting to disrupt contact of the flexible fluid flow control elements (5) with the interior wall (9) of the container (2) and upwardly moving the fluid flow control device (1).

The term "container" for the purposes of this invention broadly encompasses any container which can contain an amount of fluid (10) such as a cups, glasses, mugs, jars, cans, or the like, and while the container (2) shown in FIGS. 1 through 5 is generally cylindrical in configuration; the invention is not so limited, and a container (2) can have an interior wall (9) disposed provide surface generally in parallel opposed relation or the interior wall (9) can taper inward or taper outward, and while the container (2) shown has a generally circular configuration in top view, the container (2) can in top view have any configuration such as oval, square, triangular, diamond, or the like.

The term "fluid" for the purposes of this invention broadly encompasses any flowable substance whether liquid(s) or a gas(es) which can be contained in a container (2), such as: water, juice, coffee, tea, soft drinks, or the like; physiological fluids such as plasma, urine, serum, or the like; organic solvents, inorganic solvents, solutes dissolved in solvents; bleach, liquid detergents, liquid wax, floor polish, oil, lotions, or the like; air, purified gas, mixture of gases, or the like, or combinations thereof.

Figure 9:
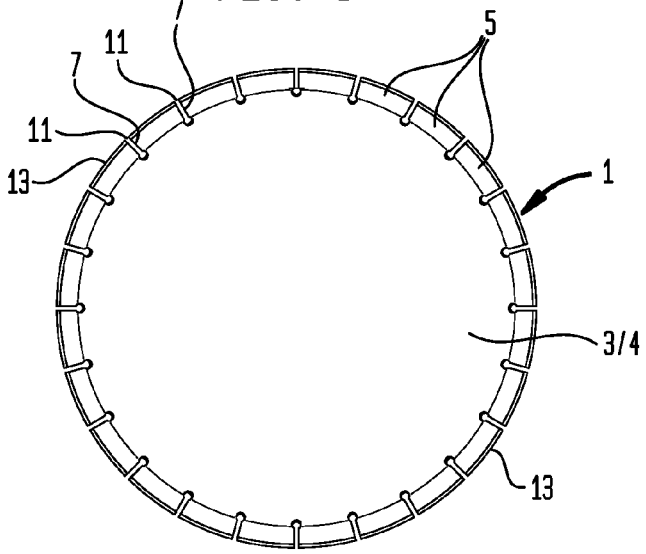
FIG. 9 is a top view of a particular embodiment of the fluid flow control device.
Figure 10:
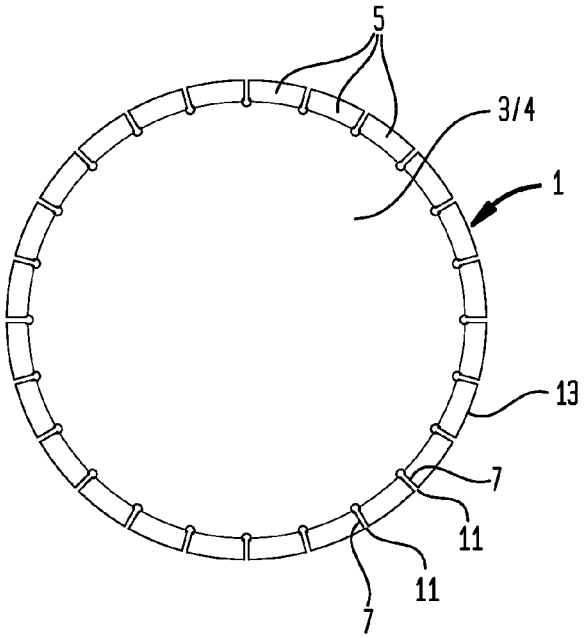
FIG. 10 is a bottom view of a particular embodiment of the fluid flow control device.
Figure 11:
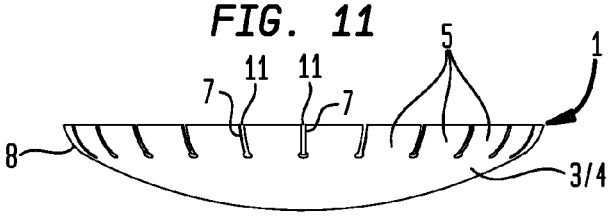
FIG. 11 is a side view of a particular embodiment of the fluid flow control device.

Now referring primarily to FIGS. 9 through 11, a particular embodiment of the fluid flow control device (1) includes a solid body (3) having a concave surface (4) extending to a peripheral edge (6). The term "solid body" for the purposes of this invention means a continuous surface unbroken by any holes, perforations, pass through, or the like, between opposed surfaces of the solid body (3). A plurality of flexible fluid flow control elements (5) can be coupled in spaced apart relation about the peripheral edge (6) of the solid body (3) defining a corresponding plurality of radial slit elements (7). Each of the plurality of flexible fluid control elements (5) can have a generally rectangular configuration subject to differences in the various configurations of the associated plurality of radial slit elements (7). As to particular embodiments, the curvature of the concave surface (4) of the solid body (3)(or a greater or lesser amount of curvature) can be extended radially outward to the outer edge (13) of each of the plurality of fluid flow control elements (5). The amount of curvature in the plurality of flexible fluid control elements (5) can be sufficient to allow contact of the curved surface (8) with the interior wall (9) of the container (2) upon positioning of the fluid control device (1) inside of the container (2) (as shown in the example of FIG. 2). The curved surface (8) of each of the flexible fluid control elements (5) afford substantial advantages over planar embodiments in that the curved surface (8) allows the fluid flow control device (1) to be more readily positioned at a location in a container (2). Additionally, the curved surface (8) of the plurality of fluid control elements (5) affords a more reliable fluid seal with the interior wall (9) of the container (2) as compared to planar embodiments. The outer edge (13) of each of the plurality of fluid flow control elements (5) can have a configuration which allows the curved surface (8) of each of the plurality of fluid flow control elements (5) to sealably contact the interior wall (9) of the container (2). As shown in the examples of FIGS. 9-11, the fluid flow control device (1) has a configuration compatible with a containers (2) having a generally circular cross-section perpendicular to the longitudinal axis (14) (as shown in the examples of FIGS. 1 through 5), accordingly the outer edge (13) of the plurality of fluid flow control elements (5) can be arcuate with a radius sufficiently greater than the radius of the interior wall (9) of the container (3) to generate upon insertion inward flexure of the plurality of fluid flow control elements (5).

Figure 6:
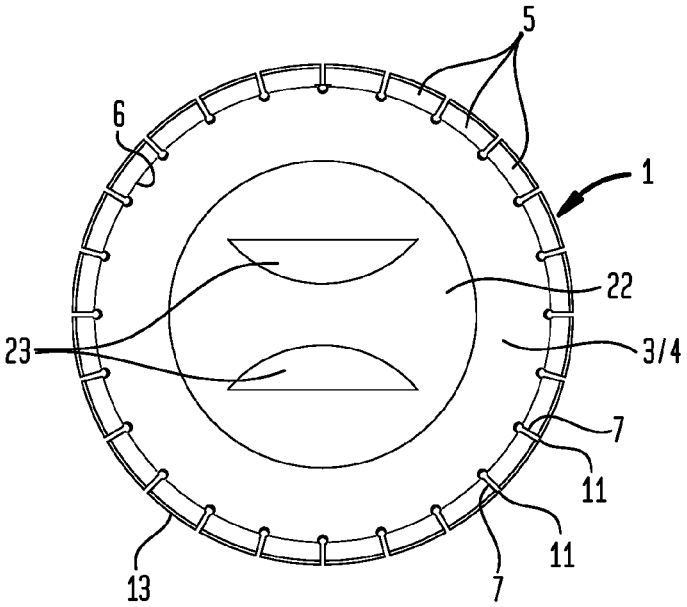
FIG. 6 is a top view of a particular embodiment of the fluid flow control device.
Figure 7:
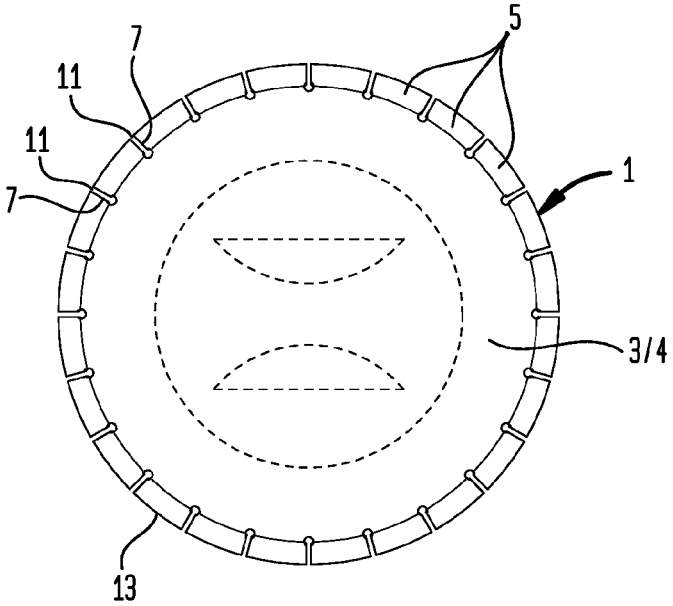
FIG. 7 is a bottom view of a particular embodiment of the fluid flow control device.
Figure 8:
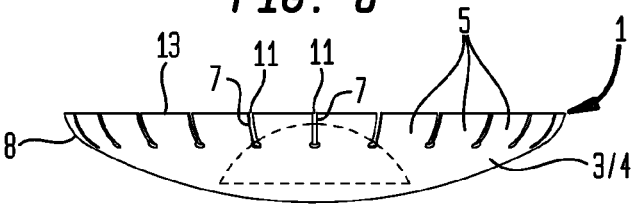
FIG. 8 is a side view of a particular embodiment of the fluid flow control device.

The fluid flow control device (1) can be produced from a wide variety of materials compatible with the a fluid (10) contained within a container (3) such as: polypropylene, acetal, acrylic, nylon, phenylene oxide, polycarbonate, polyester, polyethylene, polyethylene terephthalate, polysulfone, styrene, urethane, vinyl, silicone, epoxy, thermoplastic polymer, thermoplastic elastomer, silicone thermoplastic elastomer, paper, cardboard, metal, ceramic, or combinations thereof as mixtures, a plurality of layers, overmolds, joined parts, or the like. As to certain embodiments as shown in the examples of FIGS. 6 through 8), the solid body (3) can be produced from a first material (or combinations of materials) and the plurality of the plurality of flexible fluid control elements (5) can be produced from a second material (or combinations materials).

As one illustrative example, the solid body (3) can be molded from polypropylene generally configured as partial sphere having a radius of between about 50 millimeters (about 2 inches and about 100 millimeters (about 4 inches) and having a thickness of between about one millimeter and about two millimeters. The plurality of flexible fluid control elements (5) can be produced by overmolding the solid body (3) with a thermoplastic elastomer to provide a fluid flow control device (1) having a plurality of fluid flow control elements (5) having greater resilient flexibility (flex inward under less force) than the solid body (3). The plurality of flexible fluid control elements (5) can number between about 20 and about 30 defining a corresponding number of radial slit elements (7). The curved surface (8) of the plurality of fluid flow control elements (5) between the peripheral edge (6) of the solid body (3) and the outer edge (13) can have a lesser radius of between about 15 millimeters and about 40 millimeters. The plurality of radial slit elements (7) can each have a radial slit length (15) extending inward from the outer edge (13) of between about 2 millimeters and about 5 millimeters and a radial slit width (16) of about 0.50 millimeters and about 1.0 millimeter.

Embodiments configured as above described can confer the advantages of a central solid body (3) having sufficient rigidity to receive forcible urging to move the fluid flow control device (1) to a desired location in a container (3) without substantially deforming and positioning the plurality of fluid flow control elements (5) to sealably contact the interior wall (9) of the container (3) while further providing sufficient flexure in the plurality of fluid flow control elements (5) to readily fluidicly seal against the interior wall (9) of the container (3). Additionally, the curved surface (8) of the flexible fluid flow control elements (5) provides a contact location on the curved surface (8) which alters in response to inward flexing or outward flexing of the plurality of flexible fluid flow control elements (5) in response to change in taper of the container (2).

Now referring primarily to FIGS. 12A through 12F, which show various illustrative embodiments of the plurality of radial slit elements (7) in the unflexed condition (19)(as shown outside the container (2) in the example of FIG. 1) of the fluid flow device (1); however, the invention is not so limited, and the examples of FIGS. 12A through 12F are intended to allow a person of ordinary skill in the art to make an use a numerous and wide variety of radial slit elements (7) to address a correspondingly numerous and wide variety of container (3) and fluid (10) flow control applications. Additionally, while the examples of FIGS. 6 through 11 show embodiments of the fluid flow control device (1) having twenty four radial slit elements (7) defined by a corresponding twenty four fluid flow control elements (5); the invention is not so limited, and embodiments can include a greater or lesser number of fluid flow control elements (5) and correspondingly a greater or lesser number of radial slit elements (7), depending upon the application. The dimensional relations of each embodiment of the radial slit element (7) can be varied based on the configuration of container (3) and based on the flow characteristics of the amount of fluid (3) or other properties of the fluid (10), such as density, viscosity, temperature range, or the like.

Figure 12A:
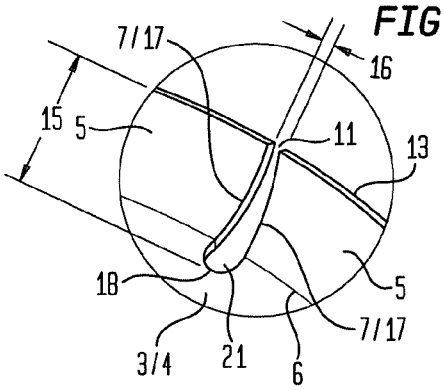
FIG. 12A is an enlarged perspective view of a particular embodiment of one of a plurality of radial slit elements coupled to the peripheral edge of an embodiment of the fluid flow control device.
Figure 12B:
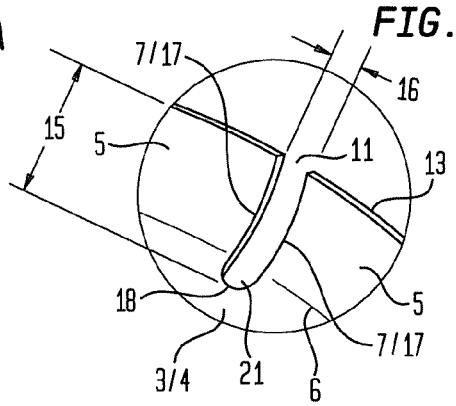
FIG. 12B is an enlarged perspective view of a particular embodiment of one of a plurality of radial slit elements coupled to the peripheral edge of an embodiment of the fluid flow control device.

Referring now to the example of FIG. 12B, particular embodiments of the radial slit element (7) can include a pair of radial slit element edges (17) disposed in substantially parallel opposed relation to provide a radial slit width (16). The radial slit element (7) can each have a radial slit length (15) extending inward from the outer edge (13) to terminate at a radial slit closed end (18). As above-described, particular embodiments can have a radial slit length (15) of between about 2 millimeters and about 5 millimeters and a radial slit width (16) of about 0.50 millimeters and about 1.0 millimeter. Upon location of the fluid flow control device (1) in a container (2) as above described, the adjacent pair of the plurality of flexible flow control elements (5) in contact with the interior wall (9) of the container (3) defines a corresponding radial slit opening (11) through which an amount of fluid (10) can flow.

Figure 12C:
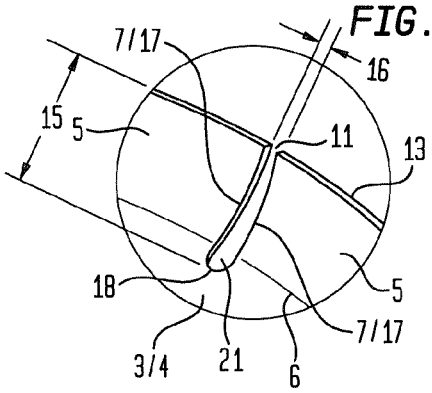
FIG. 12C is an enlarged perspective view of a particular embodiment of one of a plurality of radial slit elements coupled to the peripheral edge of an embodiment of the fluid flow control device.

Now referring primarily to the examples of FIGS. 12A and 12C, particular embodiments of the radial slit element (7) can include a pair of radial slit element edges (17) disposed in opposed relation converging approaching the outer edge (13) to provide a radial slit element (7) having greater radial slit width (16) proximate the radial slit closed end (18) and a lesser radial slit width (16) proximate the outer edge (13). The radial slit element (7) can have a radial slit length (15) extending inward from the outer edge (13) to terminate at the radial slit closed end (18). Particular embodiments can have a radial slit length (15) of between about 2 millimeters and about 5 millimeters and a radial slit width (16) of between about 0.50 millimeters and about 1.0 millimeter proximate the radial slit closed end (18) and between about 0.25 millimeters and about 0.75 millimeters at the outer edge (13). Upon location of the fluid flow control device (1) in a container (3) as above described, the plurality of flexible fluid flow control elements (5) in the flexed condition (20)(as shown in the example of FIG. 2) dispose the pair of radial slit element edges (17) proximate the outer edge (13) in contact generating a radial slit opening (11) having a location radially inward of the interior wall (9) of the container (3) through which an amount of fluid (10) can flow as shown in the example of FIG. 12H. The advantage of embodiments of radial slit element (7) configured in this manner can be that the interior wall (9) of the container (3) does not define the configuration or location of the radial slit opening (11). As can be understood by a comparison of the examples of FIGS. 12A and 12 C, the dimensional relations of the radial slit element (7) can be varied to correspondingly vary the dimensional relations of the radial slit opening (11) to adjust flow rate of an amount of fluid (10) through the radial slit opening (11).

Figure 12D:
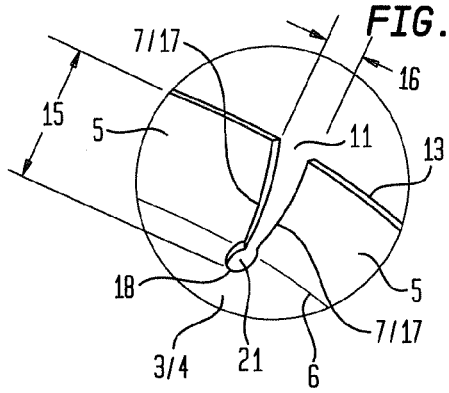
FIG. 12D is an enlarged perspective view of a particular embodiment of one of a plurality of radial slit elements coupled to the peripheral edge of an embodiment of the fluid flow control device.

Now referring primarily to the example of FIG. 12D, particular embodiments of the radial slit element (7) can include a pair of radial slit element edges (17) disposed in opposed relation diverging approaching the outer edge (13) to provide a radial slit element (7) having a lesser radial slit width (16) proximate the radial slit closed end (18) and a greater radial slit width (16) proximate the outer edge (13). The radial slit element (7) can have a radial slit length (15) extending inward from the outer edge (13) to terminate at the radial slit closed end (18). Particular embodiments can have a radial slit length (15) of between about 2 millimeters and about 5 millimeters and a radial slit width (16) of between about 0.25 millimeters and about 0.75 millimeters proximate the radial slit closed end (18) and between about 0.50 millimeters and about 1.0 millimeter at the outer edge (13). Upon location of the fluid flow control device (1) in a container (3) as above described, the plurality of fluid flow control elements (5) in the flexed condition (20) dispose the pair of radial slit element edges (17) proximate the outer edge (13) a lesser distance apart as shown in the example of FIG. 12G. The advantage of embodiments of a radial slit element (7) configured in this manner can be that if interior wall (9) of the container (3) has a taper, the fluid flow control device (1) can be secured over a greater range of travel inside the container (3) as compared to embodiments having a configuration shown in the examples of FIGS. 12A through 12C.

Figure 12E:
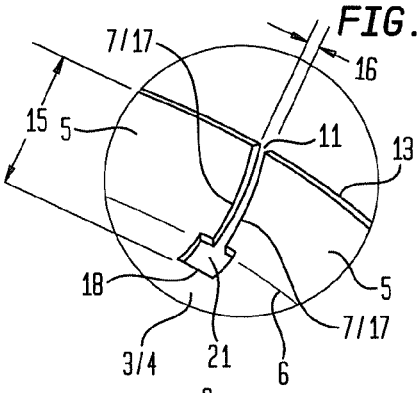
FIG. 12E is an enlarged perspective view of a particular embodiment of one of a plurality of radial slit elements coupled to the peripheral edge of an embodiment of the fluid flow control device.
Figure 12F:
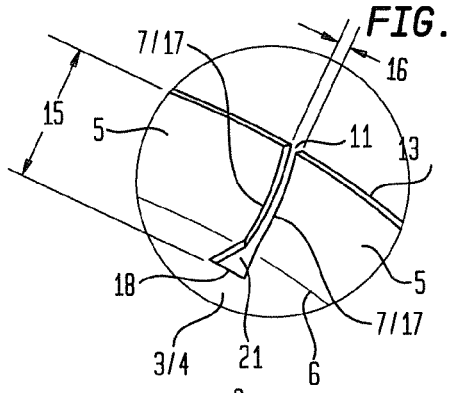
FIG. 12F is an enlarged perspective view of a particular embodiment of one of a plurality of radial slit elements coupled to the peripheral edge of an embodiment of the fluid flow control device.
Figure 12G:
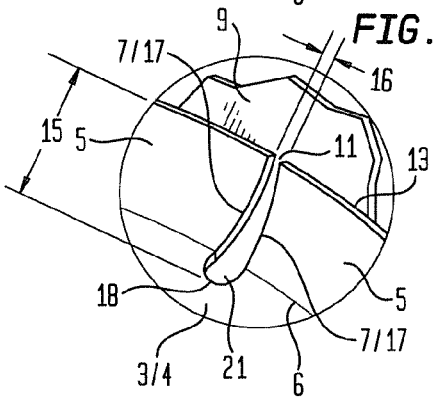
FIG. 12G is an enlarged perspective view of a particular embodiment of the plurality of fluid flow control elements in the flexed condition to dispose the pair of radial slit element edges proximate the outer edge a lesser distance apart.
Figure 12H:
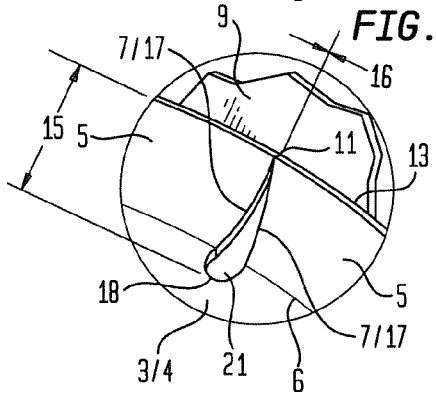
FIG. 12H is an enlarged perspective view of a particular embodiment of one of a plurality of radial slit elements coupled to the peripheral edge of an embodiment of the fluid flow control device.

Now referring primarily to the examples of FIG. 12D through 12F, particular embodiments of the radial slit element (7) can include a pair of radial slit element edges (17) disposed as described in any of the examples of FIGS. 12A through 12 and further including various configurations of a radial slit terminal element (21). As shown in the example FIG. 12D, the radial slit terminal element (21) can have a generally circular configuration, or as shown in the example of FIG. 12E can have a generally square configuration, or as shown in the example of FIG. 12F can have a generally triangular configuration; however, the examples are not intended to limit the invention, but rather, provide a sufficient number of examples for a person of ordinary skill in the art to make and use the numerous and varied configurations of the radial slit terminal element (21) to increase or reduce resilient flexibility in the plurality of fluid flow control elements (5) or increase or reduce the flow rate of the amount of fluid (10) through the radial flow slit (7), depending upon the application.

Now referring primarily to FIGS. 1 through 3 and FIGS. 6 through 8, particular embodiments can further include a grip element (22) having a configuration which allows engagement of the fluid flow control device (1) by the user to assist in general handling and in particular positioning the fluid flow control device (1) in a container (3) or removal of the fluid flow control device (1) from the container (3). While the examples shown in FIGS. 1 through 3 and FIGS. 6 through 8, provide a grip element (22) configured as a pair of grip members (23) disposed in opposed relation a distance apart with each of the pair extending sufficiently outward from the solid body (3) to allow gripping engagement with the thumb and a finger of a user; however, the invention is not so limited, and inventions can include any configuration of the grip element (22) useful in handling the fluid flow control device (1). For example, the grip element (22) can take the form of a centrally located protuberance such as a knob, a pull, a handle, or the like. The grip element (22) can as to particular embodiments be formed, fabricated or molded as one piece with the solid body (3) or can be formed as a separate element coupled in a separate step to the solid body (3) by adhesive, solvents, mechanical fasteners or the like, or combinations thereof. As to certain embodiments, the solid body can have sufficient resilient flexure to sufficiently deform in response to gripped engagement of said pair of grip members (23) to alter dimensional relations of said fluid flow control device (1) to allow positioning inside of the container (2) or removal from the container (2).

Figure 16:
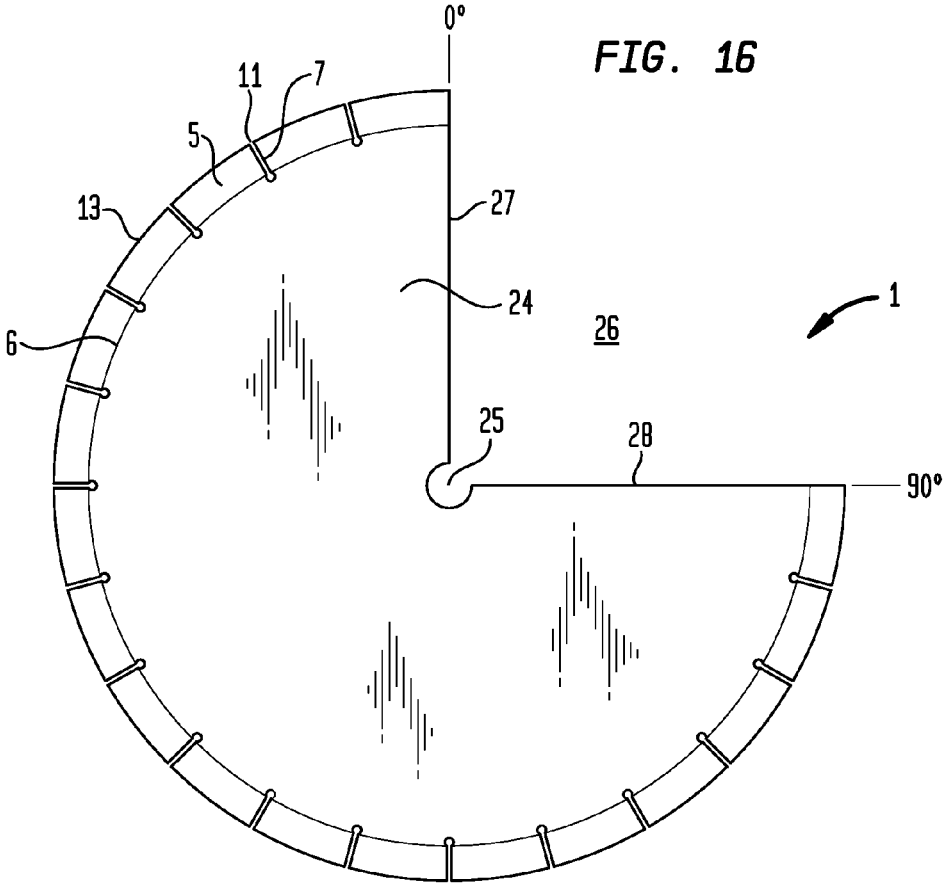
FIG. 16 is a top view of a particular embodiment of a fluid flow control device.
Figure 17:
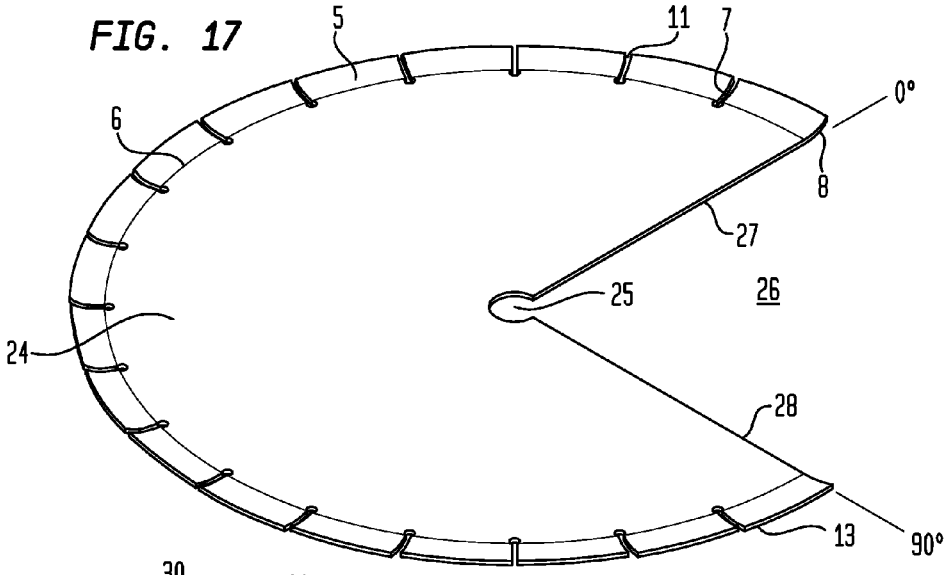
FIG. 17 is a perspective of a particular embodiment of a fluid flow control device.
Figure 18:
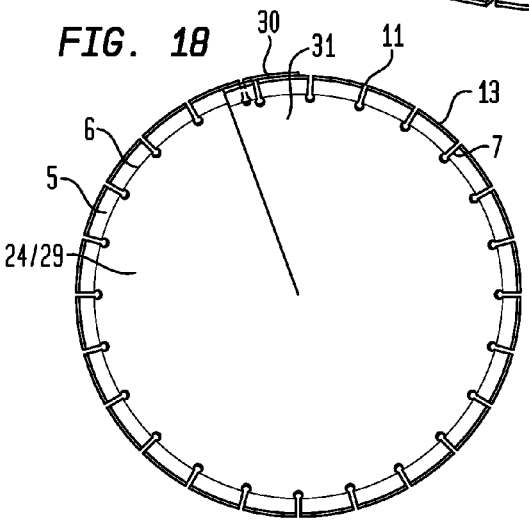
FIG. 18 is top view of a particular embodiment of a fluid flow control device.
Figure 20:
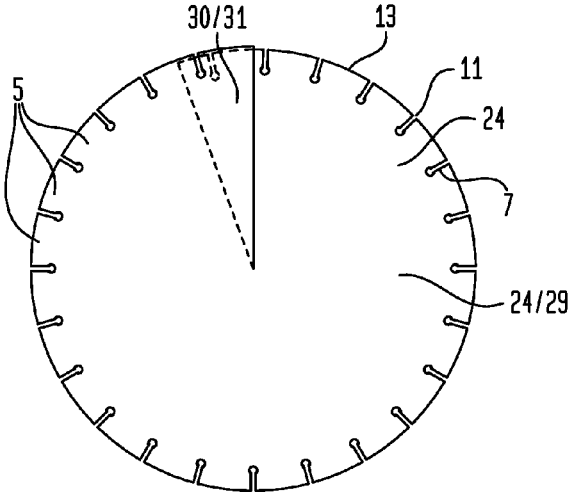
FIG. 20 is bottom view of a particular embodiment of a fluid flow control device.

Now referring primarily to FIGS. 16 and 17, an embodiment of the fluid flow control device (1) can provide a flexible body (24) having a generally planar configuration extending outward from the center (25) to a generally circular peripheral edge (6) at which a plurality of flexible flow control elements (5) couple as above described. The plurality of flexible flow control elements (5) define a corresponding plurality of radial slit elements (7), as above described, and can include the curved surface (8) and take one or more of the forms shown in the examples of FIGS. 12A through 12F as above described. The outer edge (13) can be generally circular or arcuate in form. The flexible body (24) can have a cutout (26) defined by a pair of body edges (27)(28) each extending from the center (25) to intersect the outer edge (13). The first of the pair of body edges (27) extends from the center (25) to intersect the outer edge (13) at about 0° (as shown in the example of FIGS. 16 and 17) and the second of the pair of body edges (28) extends from the center (25) to intersect the outer edge (13) at between about 10° and about 90° (as shown in the example of FIGS. 16 and 17). The cutout (26) allows the pair body edges (27)(28) to be drawn toward each other and the portions of the flexible body (25) proximate the pair of body edges (27)(28) to be overlapped to form a cone (29)(as shown in the examples of FIGS. 18 and 20). The overlapped portions (30)(31) can be adjusted to be greater or lesser to correspondingly adjust the diameter of the cone (29) defined by the outer edge (13).

Figure 19:
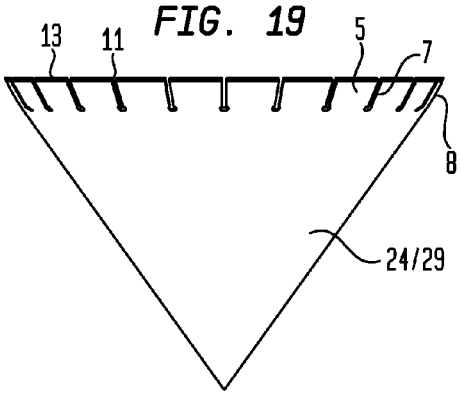
FIG. 19 is side view of a particular embodiment of a fluid flow control device.

Now referring primarily to FIGS. 18 through 20, other embodiments provide the flexible body (24) pre-formed in the configuration of a cone (29) with overlapped portions (30)(31), as above described, whether by molding, pressing, forming, or otherwise. The flexible body (24) can have sufficient resilient flexibility to dispose the overlapped portions (30)(31) in slidable relation to allow adjustment of the diameter defined by the outer edge (13).

Particular embodiments of FIGS. 13 through 20 can be produced from materials as above described for the examples shown in FIGS. 1 through 12F including a flexible body (24) formed of polypropylene or other flexible material or combinations thereof and as to particular embodiments can provide the plurality of flexible fluid flow control elements (5) as overmolded thermoplastic elastomer.

Figure 13:
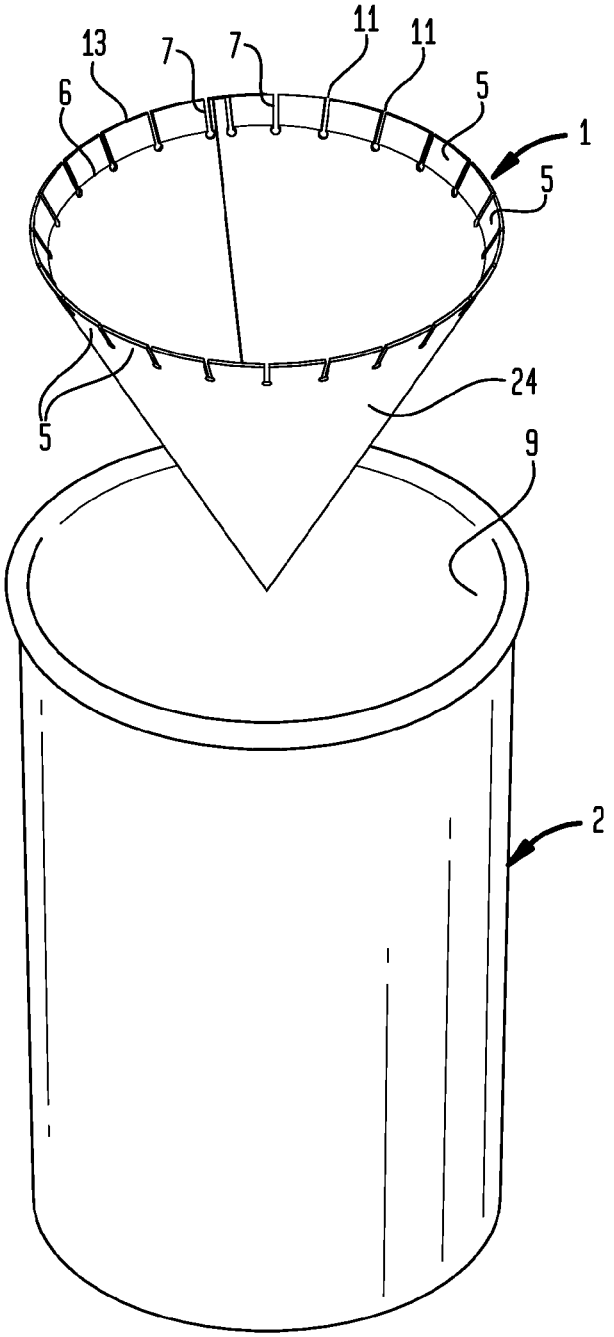
FIG. 13 is an illustration of providing a particular embodiment of a fluid flow control device configured to fit a container.
Figure 14:
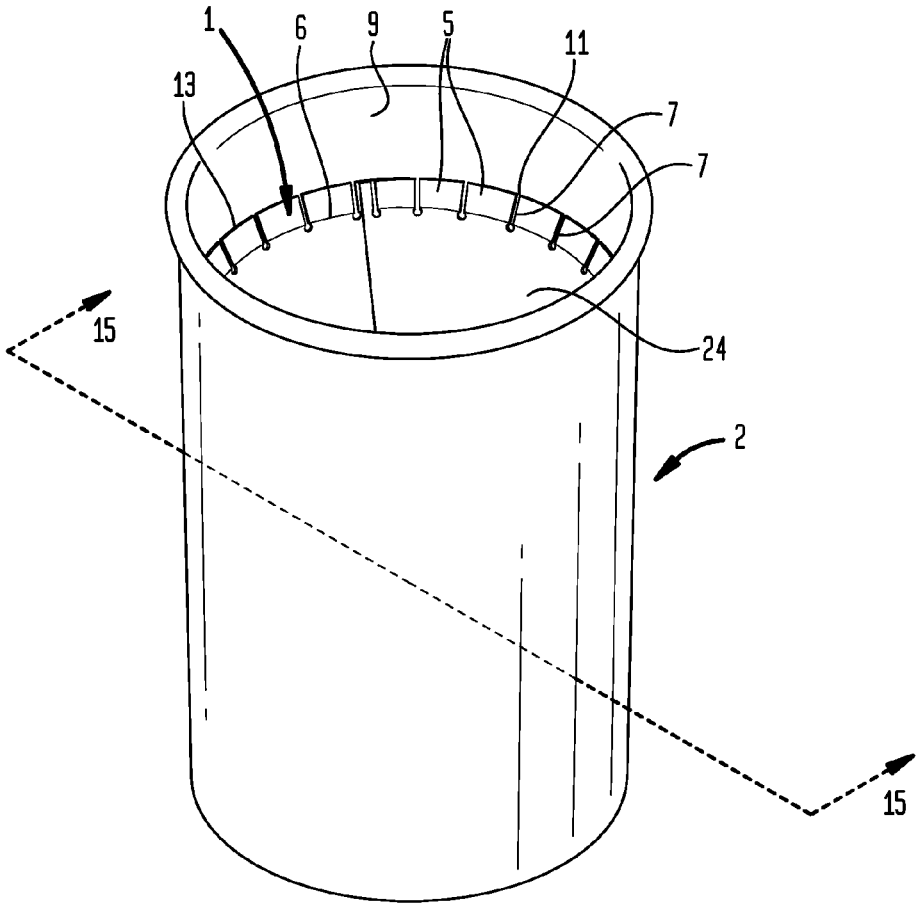
FIG. 14 is an illustration of positioning a particular embodiment of a fluid flow control device in a container.
Figure 15:
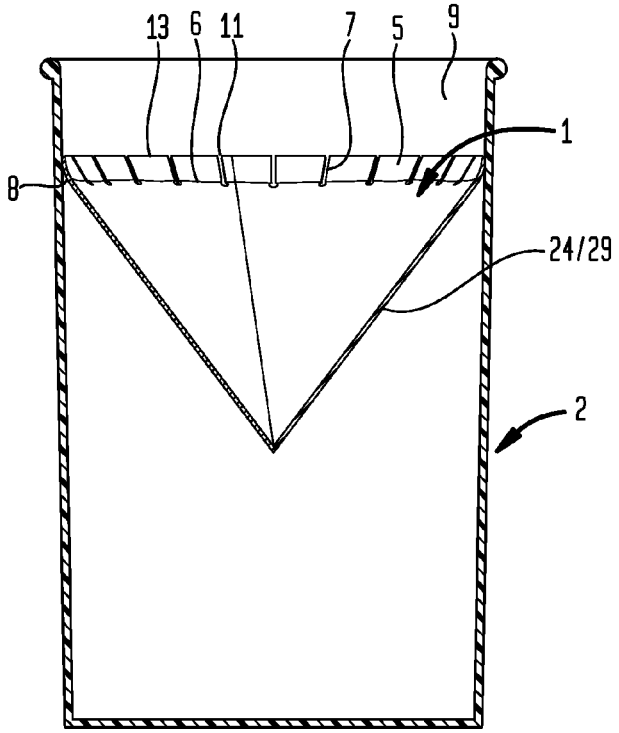
FIG. 15 is cross section 15-15 as shown in FIG. 14 which shows a particular embodiment of the fluid flow control device inserted in a container.

Now referring primarily to FIGS. 13 through 15, embodiments of the fluid flow control device (1) having a flexible body (24) in the configuration of a cone (29) (as shown in the examples of FIGS. 18-20) can be located inside a container (2). By contacting the outwardly disposed curved surface (8) of each of a plurality of flexible fluid flow control elements (5) with a corresponding portion of the interior wall (9) of the container (2) the overlapped portions (30)(31) can slide in relation to each other to adjust the diameter of the cone (29) defined by the outer edge (13) in correspondence to the diameter of the interior wall (9) of the container (2). The fluid flow control device (1) can be positioned by upward or downward movement in the container (2). Resilient flexure of the plurality of flexible fluid flow control elements (5) in contact with the interior wall (9) of the container (2) can secure location of the fluid flow control device (1) in relation to the interior wall (9) of the container (2)(as shown in the examples of FIGS. 14 and 15).

The container (2) can be sufficiently tilted to allow flow of the fluid (10) through a plurality of radial slit openings (11) defined by a plurality of radial slit elements (7)(as shown by the example of FIG. 3). As to certain embodiments, the plurality of radial slit elements (7) can be configured to control the fluid flow rate through the corresponding plurality of radial slit openings (11) to allow flow of the fluid (10)(as shown in the example of FIG. 3) from the container (2). Additionally, the plurality of slit elements (7) can be configured to interrupt flow of the fluid (10) when the container (2) is inverted (as shown by the example of FIG. 5).

As can be easily understood from the foregoing, the basic concepts of the present invention may be embodied in a variety of ways. The invention involves numerous and varied embodiments of a fluid flow control device for a container and methods of fluid flow from a container including, but not limited to the best mode of the invention.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of "a container" should be understood to encompass disclosure of the act of "containing"—whether explicitly discussed or not—and, conversely, were there effectively disclosure of the act of "containing", such a disclosure should be understood to encompass disclosure of "container" and even a "means for containing." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment.

Thus the applicant(s) should be understood to claim at least: i) fluid flow control device as herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this international PCT patent specification are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A fluid flow control device, comprising:

a) a solid body; and b) a plurality of flexible fluid flow control elements radially extending in spaced apart relation about a peripheral edge of said solid body to define a generally circular outer edge, said plurality of flexible fluid flow control elements in a resting condition include a bottom side having a curved surface radially extending between about said peripheral edge of said body and said generally circular outer edge, said plurality of flexible fluid flow control elements defining a corresponding plurality of radial slit elements extending outwardly from a radial slit closed end proximate said peripheral edge of said body to said generally circular outer edge of said curved surface of said bottom side of said plurality of flexible fluid control elements capable of contacting an interior wall of a container to positionally secure said fluid flow control device and to control flow of a fluid from said container through said plurality of radial slit elements.

2. The fluid flow control device of claim 1, wherein said solid body of a first material and said plurality of flexible fluid control elements of a second material, said second material having greater resilient flexure compared to said first material.

3. The fluid flow control device of claim 2, wherein said first material comprises a thermoplastic polymer material and said second material a thermoplastic elastomer.

4. The fluid flow control device of claim 3, wherein said plurality of flexible fluid control elements overmold said solid body.

5. The fluid flow control device of claim 1, wherein each of said plurality of radial slit elements has a radial slit length between said radial slit closed end proximate said peripheral edge of said solid body to said outer edge of said fluid flow control device.

6. The fluid flow control device of claim 5, wherein each of said plurality of radial slit elements has a pair of radial slit element edges which define a radial slit width.

7. The fluid flow control device of claim 6, wherein said pair of radial slit element edges disposed in generally opposed parallel relation define said radial slit width.

8. The fluid flow control device of claim 6, wherein said pair of radial slit element edges converge approaching said outer edge.

9. The fluid flow control device of claim 8, wherein said radial slit has a greater radial slit width proximate said radial slit closed end.

10. The fluid flow control device of claim 6, wherein said pair of radial slit element edges diverge approaching said outer edge.

11. The fluid flow control device of claim 10, wherein said radial slit has a greater radial slit width proximate said outer edge.

12. The fluid flow control device of claim 6, wherein said plurality of flexible fluid control elements sufficiently inwardly flex to reduce said radial slit width proximate said outer edge.

13. The fluid flow control device of claim 6, wherein said plurality of flexible fluid control elements sufficiently inwardly flex to allow contact of said pair of radial slit element edges proximate said outer edge.

14. The fluid flow control device of claim 13, wherein contact of said pair of radial slit element edges proximate said outer edge generate a radial slit opening located radially inward of said outer edge.

15. The fluid flow control device of claim 5, wherein said radial slit closed end further comprises a radial slit terminal element.

16. The fluid flow control device of claim 15, wherein variation in configuration of said radial slit terminal element correspondingly varies resilient flexure in said plurality of flexible fluid control elements.

17. The fluid flow control device of claim 15, wherein variation in configuration of said radial slit terminal element correspondingly varies flow rate of said fluid from said container.

18. The fluid flow control device of claim 15, where said radial slit terminal element has a configuration selected from the group consisting of: circular, square, rectangular, triangular, oval, and semi-circular.

19. The fluid flow control device of claim 1, further comprising a grip coupled to said solid body.

* * * * *